United States Patent [19]

Clark

[11] 4,091,805

[45] May 30, 1978

[54] VIBRATING BACK SCRATCHER

[75] Inventor: Madalin M. Clark, Wytheville, Va.

[73] Assignee: The Raymond Lee Organization, Inc., New York, N.Y. ; a part interest

[21] Appl. No.: 778,835

[22] Filed: Mar. 18, 1977

[51] Int. Cl.[2] ..... A61H 1/00

[52] U.S. Cl. ..... 128/41; 128/62 R

[58] Field of Search ..... 128/32, 41, 62 R, 61, 128/51, 52

[56] References Cited

U.S. PATENT DOCUMENTS

| | | | |
|---|---|---|---|
| D. 35,313 | 11/1901 | Wirt | 128/67 UX |
| 2,806,235 | 9/1957 | Carstairs et al. | 128/62 R |
| 3,094,982 | 6/1963 | Krenzke et al. | 128/32 |

*Primary Examiner*—Lawrence W. Trapp

*Attorney, Agent, or Firm*—Daniel Jay Tick

[57] ABSTRACT

An artificial hand having a plurality of fingers bent in scratching position, is affixed at the wrist to a first end of an elongated rod. An electric vibrator is coupled to the other end of the rod in a hollow handle accommodating such end of the rod. The vibrator is energized by a battery to vibrate the rod and the hand in axial directions.

2 Claims, 4 Drawing Figures

VIBRATING BACK SCRATCHER

BACKGROUND OF THE INVENTION

The present invention relates to a vibrating back scratcher.

Objects of the invention are to provide a vibrating back scratcher of simple structure, which is inexpensive in manufacture, used with facility, convenience and safety, and functions efficiently, effectively and reliably to scratch the back of a user.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
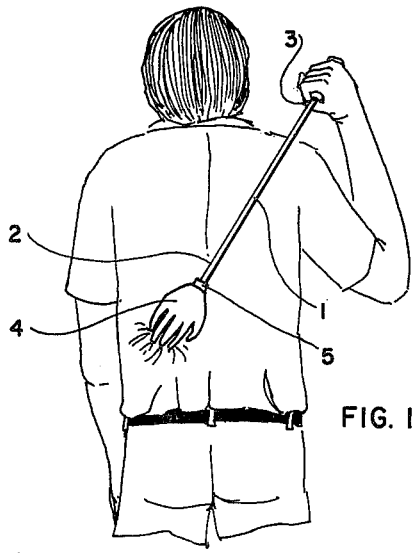
FIG. 1 is a view of an embodiment of the vibrating back scratcher of the invention in use.
Figure 2:
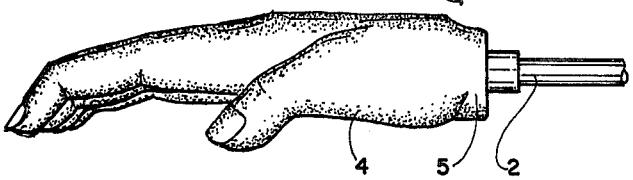
FIG. 2 is a side view, on an enlarged scale, of the embodiment of FIG. 1.
Figure 2:
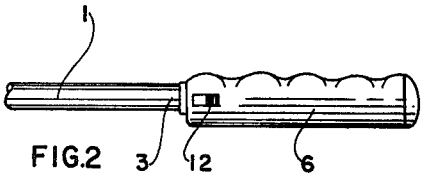

The vibrating back scratcher of the invention comprises an elongated rod 1 (FIGS. 1 to 3) having spaced opposite first and second ends 2 and 3 (FIGS. 1 and 2). An artificial hand 4 (FIGS. 1 and 2) of any suitable material such as, for example, plastic, has a plurality of fingers bent in scratching position and a wrist 5. The hand 4 is affixed at the wrist 5 thereof to the first end 2 or the rod 1.

A hollow handle 6 (FIGS. 2 and 3) has an open end 7 (FIG. 3) and coaxially accommodates the second end 3 of the rod 1 via the open end thereof.

Figure 4:
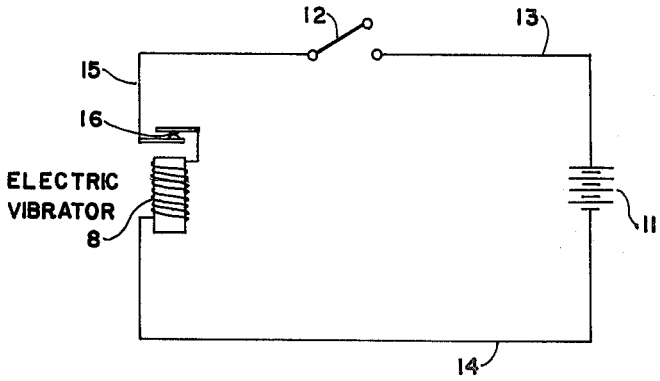
FIG. 4 is a circuit diagram of the vibrating back scratcher of the invention.
Figure 3:
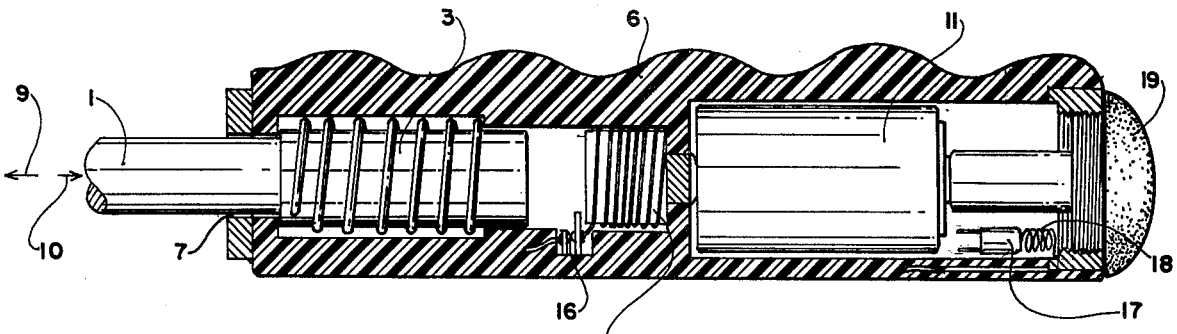
FIG. 3 is a view, on an enlarged scale, partly in section, of the handle part of the embodiment of FIG. 2.

An electric vibrator device 8 of any suitable type (FIGS. 3 and 4) is provided in the handle 6 in operative proximity with the second end 3 of the rod 1 for vibrating the rod in axial directions, indicated by arrows 9 and 10 of FIG. 3.

A rechargeable battery or batteries 11 (FIGS. 3 and 4) is provided in the handle 6 for energizing the electric vibrating device or vibrator 8.

An ON-OFF switch 12 (FIGS. 2 and 4) is provided in the handle 6 and extends therefrom for manual operation thereof. Electrical conductors 13, 14, 15 (FIG. 4) in the handle 6 electrically connect the vibrator 8, the battery 11 and the switch 12 in circuit whereby the vibrator is energized by the battery under the control of the switch to vibrate the rod 1 and the hand 4 in axial directions 9 and 10.

Although the vibrator 8 comprises any suitable vibrating device, it preferably comprises an electromagnet and a circuit interrupting switch 16 (FIGS. 3 and 4) controlled in operation by the electromagnet.

The battery 11 is recharged by any suitable device such as, for example, an electric connector plug 17 (FIG. 3) suitably electrically connected to recharge said battery. The connector plug 17 is connected via coiled electric conductors 18 (FIG. 3) so that it is readily extended to an electric wall outlet for the recharging power, when the removable cover 19 at the end of the handle 6 (FIGS. 2 and 3) is removed.

While the invention has been described by means of a specific example and in a specific embodiment, I do not wish to be limited thereto, for obvious modifications will occur to those skilled in the art without departing from the spirit and scope of the invention.

I claim:

1. A vibrating back scratcher, comprising an elongated rod having spaced opposite first and second ends;

an artificial hand having a plurality of fingers bent in scratching position and a wrist, said hand being affixed at the wrist thereof to the first end of the rod;

a hollow handle having an open end and coaxially accommodating the second end of the rod via the open end thereof;

an electric vibrating device in the handle in operative proximity with the second end of the rod for vibrating the rod in axial direction;

rechargeable battery means in the handle for energizing the vibrating device;

ON-OFF switch means in the handle and extending therefrom for manual operation thereof; and electrical conductors in the handle electrically connecting the vibrating device, the battery means and the switch means in circuit whereby the vibrating device is energized by the battery means under the control of the switch means to vibrate the rod and the hand in axial directions.

2. A vibrating back scratcher as claimed in claim 1, wherein the vibrating device comprises an electromagnet and a circuit interrupting switch controlled in operation by the electromagnet.

* * * * *